United States Patent [19]

Wheeler

[11] Patent Number: 4,566,228

[45] Date of Patent: Jan. 28, 1986

[54] WORKPIECE GUIDES

[75] Inventor: Stanley G. Wheeler, Peterborough, United Kingdom

[73] Assignee: The Newall Engineering Company Limited, Peterborough, United Kingdom

[21] Appl. No.: 582,551

[22] Filed: Feb. 22, 1984

[51] Int. Cl.[4] ..... B24B 41/06

[52] U.S. Cl. ..... 51/238 S; 82/38 R

[58] Field of Search ..... 51/238 S, 236 R, 237 CS; 82/38, 39

[56] References Cited

U.S. PATENT DOCUMENTS

| | | | |
|---|---|---|---|
| 2,612,014 | 9/1952 | Mathewson | 82/39 X |
| 3,076,296 | 2/1963 | Joyce | 51/238 S X |
| 3,904,390 | 9/1975 | Bottomley | 82/38 R X |
| 4,276,723 | 7/1981 | Fournier | 51/238 S |

FOREIGN PATENT DOCUMENTS

| | | | |
|---|---|---|---|
| 736712 | 9/1955 | United Kingdom | 51/238 S |

*Primary Examiner*—Frederick R. Schmidt
*Assistant Examiner*—Debra S. Meislin
*Attorney, Agent, or Firm*—Watson, Cole, Grindle & Watson

[57] ABSTRACT

The disclosure relates to a workpiece guide for supporting a rotary workpiece comprising a housing in which an assembly of three jaw members is mounted on the base to embrace and support a workpiece for rotation about an axis defined by the positions of the jaw members. Common drive means close the jaw members to hold the workpiece for rotation in the jaw members. The jaw assembly has an adjustable mounting to alter the position of the axis defined by the jaw members whereby the axis can be set to coincide with an axis of a machine tool on which the guide is to be used and a workpiece then supported on that axis in the guide. Having closed the jaw members on a workpiece the drive means releases the members slightly to allow a running clearance for the workpiece in the jaws.

22 Claims, 7 Drawing Figures

WORKPIECE GUIDES

BACKGROUND OF THE INVENTION

1. Field of the Invention

This invention relates to workpiece guides particularly for use in machine tools such as grinding machines in which the elongate rotary workpiece is supported at one or both ends and/or at an intermediate position of its length for a machining operation.

2. Description of the Prior Art

Presently most cam grinding machines utilise workpiece steady rests which have contact shoes which are either set at fixed positions set to support a main bearing at the maximum outer diameter tolerance in which case smaller diameter bearings are loose in the steady rest while camshafts having over tolerance main bearings are marked due to excessive gripping pressure, or two fixed tips may be provided with one spring loaded grip to ensure a clearance free support. However, as main journals may have diametral tolerances of 0.015 mm to 0.02 mm, whilst maintaining shake free support of the journal, the journal centre-line will vary by plus or minus 0.01 mm relative to the axis about which the cams are ground. Thus although the problem of excessive gripping pressure which can arise with a case of three fixed support points is overcome, another problem, that is supporting the journal off-centre from the correct centre-line is introduced.

U.S. Pat. No. 4,276,723 discloses a stead rest for supporting a workpiece to be ground comprising three contact shoes which are simultaneously movable towards and away from the workpiece centre-line so that workpieces of varying diameter can be supported and maintained on a fixed centre line of rotation. The top contact shoe is mounted for pivotal movement to a position clear of the work area to facilitate loading and unloading of the workpiece, one hydraulic operator being provided for pivoting the top contact shoe into and out of its operative position and a second operator being provided for moving the two lower non-pivoting contact shoes towards or away from a workpiece. Whilst provision is made for adjusting the three point support to suit bearings of different diameters, no provision is made for ensuring that the supports hold the bearing on the required centre-line axis whilst at the same time avoiding excessive gripping pressure applied to the bearing.

SUMMARY OF THE INVENTION

This invention provides a workpiece guide for supporting a rotary workpiece comprising a base, three jaw members movably mounted on the base to embrace and suppor a workpiece for rotation about an axis defined by the position of the jaw members, drive means for closing the jaw members to grip the workpiece and for releasing the members sufficiently to permit the workpiece to rotate therein whilst still supported coaxially with the axis by the jaw members, and means to adjust the jaw members to alter the position of the axis defined by such jaw members whereby the axis can be set to coincide with an axis of a machine tool on which the guide is to be used and a workpiece then supported on that axis in the guide.

Since the jaw member assembly can be adjusted as a whole, the axis about which the assembly supports a component can be set precisely irrespective of the variation in size of the component and since the jaw assembly is first closed on the component and then all the jaws are opened slightly free running of the component in the jaws is ensured.

DESCRIPTION OF THE PREFERRED EMBODIMENT

Figure 1:
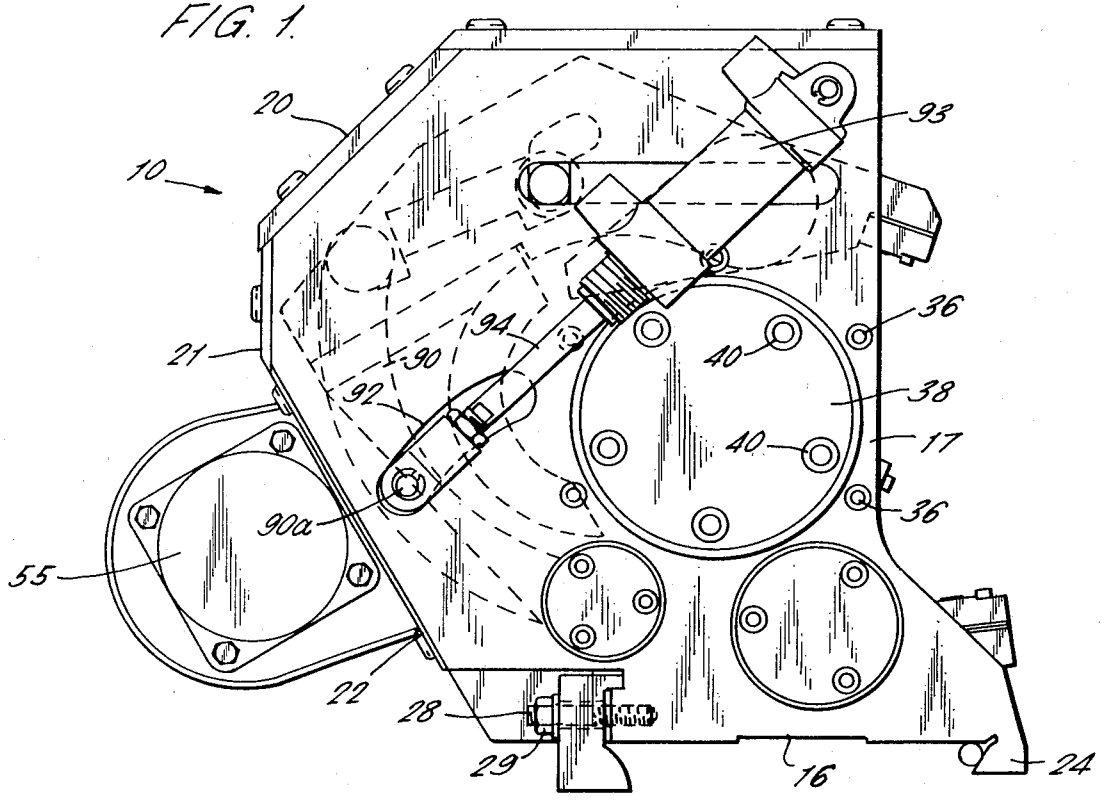
FIG. 1 is a side elevation of a workpiece guide taken from one side of the guide.
Figure 2:
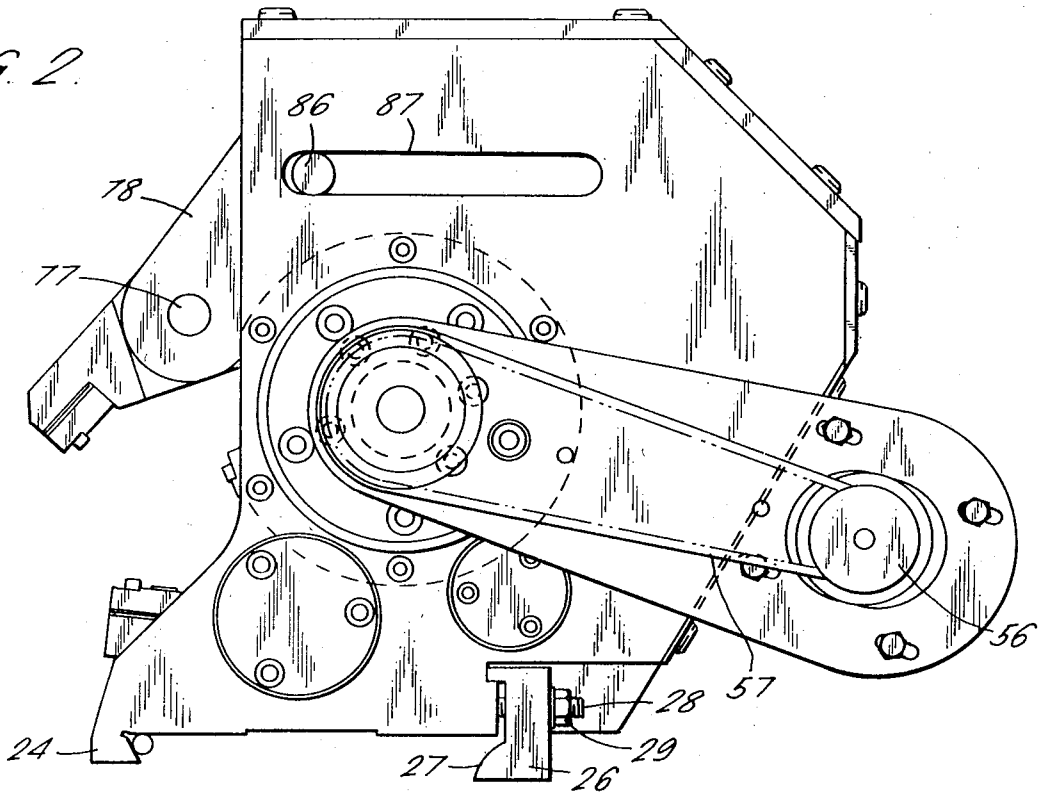
FIG. 2 is a side elevation of a workpiece guide looking at the opposite side.
Figure 3:
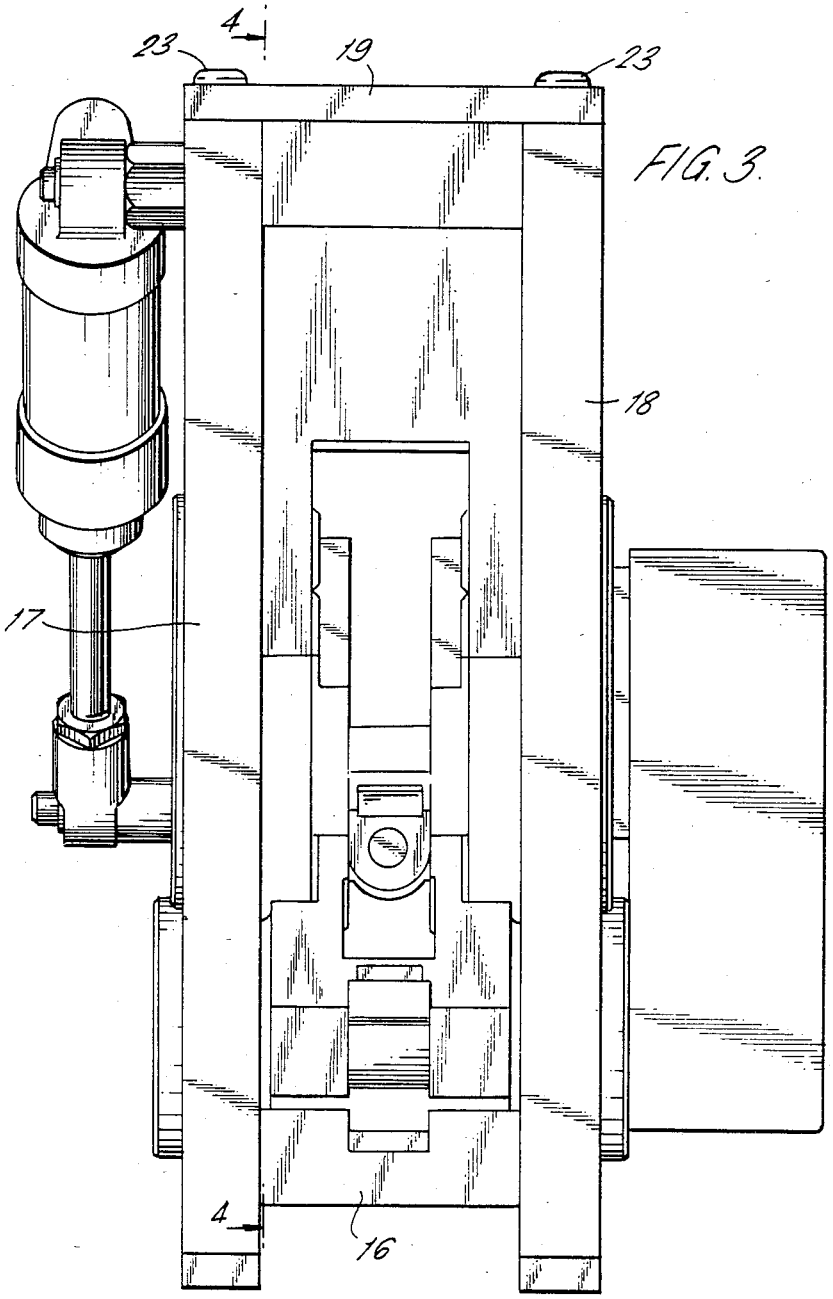
FIG. 3 is a front elevation of the workpiece guide.

The drawings illustrate a workpiece guide for a machine tool for supporting an elongate workpiece to be rotated at an intermediate position along the length of the workpiece and/or at an end of the workpiece to ensure that the workpiece axis coincides with the axis of rotation of the machine tool. The workpiece guide is, by way of example, particularly applicable to grinding machines for grinding the cam lobes on motor vehicle camshafts. Examples of such machines are described and illustrated in our U.K. Pat. No. 1596635 and U.S. Pat. No. 4,501,093 commonly owned herewith.

Referring now to FIGS. 1 to 4 of the drawings, there is shown a workpiece guide for use on a machine tool having a bed formed with a slideway on which centres or chucks are mounted to support a workpiece for rotation about a fixed axis extending parallel to the slideway. The workpiece guide comprises a housing indicated generally by the reference numeral 10 to be mounted on the slideway of the machine tool bed. The fixed axis of rotation of the machine tool is indicated at 11 and the housing has an open front 12 from which three workpiece guides 13, 14 and 15 project to encircle the axis 11 and support a workpiece for rotation on the axis as described below.

The housing comprises a base member 16 to which two upstanding parallel side walls 17, 18 are attached. The housing is completed by a top wall 19 and rear walls 20, 21 and 22 all secured to the side walls by screws 23. The front side of the housing is left open as indicated above for the guide members 13 to 15 to project from.

In use the housing is mounted with the base member 16 on the upper surface of the slide of a machine tool bed which is not illustrated. The slideway is of dovetail cross-section and, to lock the housing to the base, the lower ends of the side walls 17, 18 at the front of the housing have downwardly projecting lugs 24 extending below the basemember base member 16 which are undercut as indicated at 25 on the sides thereof facing across the base to engage one side of the dovetail section slideway. The clamp 26 extends across the other side of the base member 16 and is undercut as indicated at 27 to engage the other side of the dovetail section slideway. The clamp 26 is secured to the base 16 by means of screw threaded studs 28 projecting from the base member 16 through the clamp 26 to receive nuts 29 for tightening the clamp 26 against the side of the slideway to lock the housing to the slideway.

Figure 7:
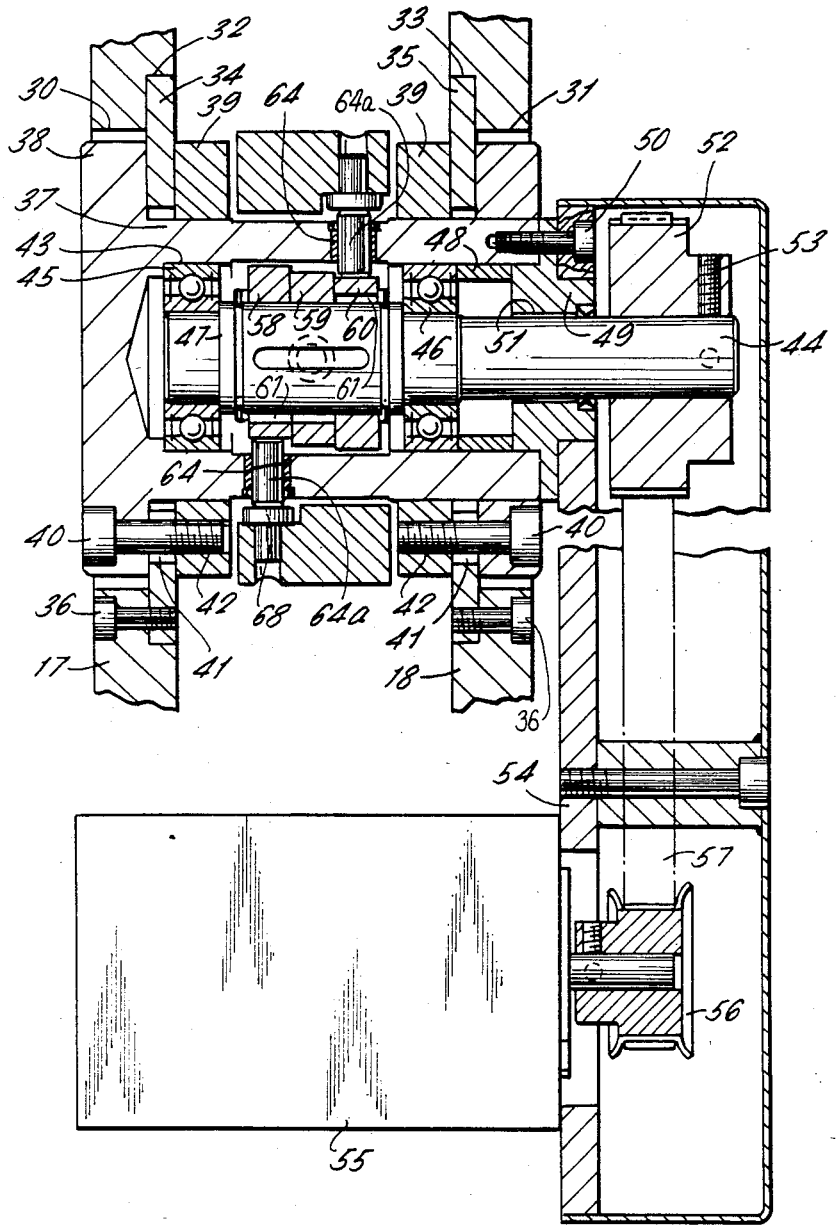
FIG. 7 is a section on the line 7—7 on FIG. 4.

Referring to FIG. 7 of the drawings, the sidewalls 17, 18 of the housing are formed with oppositely facing coaxial circular apertures 30, 31, respectively. The inner sides of the side walls around the apertures 30, 31 are rebated as indicated at 32 and 33 respectively to receive annular plates 34, 35 respectively which project into the apertures 30, 31 and are secured in the rebates by set screws 36. A hollow cylindrical hub 37 extends through the annular plates 34, 35 with clearance between the outer surface of the hub and the inner peripheries of the plates to permit radial adjustment of the hub in the plates. One end of the hub located in the aperture in plate 17 is closed and is formed with an outwardly projecting integral flange 38 which bears on one side of the annular plate 34. A separate collar 39 freely slidable along the hub engages the other side of the plate 34. Set screws 40 countersunk into the flange 38 extend through the flange, with clearance through openings 41 in the plate 34 and into screw threaded bores 42 in the collar 39. With the screws 40 slackened to release the clamping pressure of the flange 38 and collar 39 to the ring 34, the end of the hub can be adjusted radially with respect to the annular plate 34. The screws 40 can then be tightened to lock the end of the hub in the required position of adjustment. At the other end of the hub in the aperture in plate 35 two separate collars 39 encircle the hub on either side of plate 35 to support the hub radially and are locked together by screws 40 countersunk into the outer flange 39 and extending through openings 41 in the annular plate 35 into screw threaded bores 42 in the inner collar 39. Thus when the screws 40 are slackened, the hub can be adjusted radially in any direction as required and can then be locked into place by tightening the screws 40 to clamp the flange 38, collar 39 and annular plate 34 at one end of the hub together and to clamp the collar 39 and annular 35 at the other end of the hub together.

The hub 37 has a central bore 43 in which a shaft 44 is mounted in bearings 45 and 46. The shaft 44 has an enlarged diameter portion 47 and the inner races of the bearings 45, 46 are lodged against the shoulders at the ends of the enlarged diameter portion. The outer race of bearing 45 lies against the end of the bore 43 in the hub and the outer race of the bearing 46 is held in place by a sleeve 48 located in the hub and itself locked in place by an end cap 49 secured to the end of the hub by set screws 50. The end cap 49 has a central bore 51 through which the shaft 44 extends with clearance.

The end of the shaft 44 projecting from the end cap 49 carries a toothed pulley 52 secured in place by a screw 53. Set screws 50 also serve to secure an elongate plate 54 to the end cap, the plate extending to the rear of the housing. At the rear of the housing a stepper motor 55 is mounted on the plate 54 and has a toothed output pulley 56 with a tooth belt drive 57 to the tooth pulley 52 to rotate the shaft 44 as described later.

Figure 4:
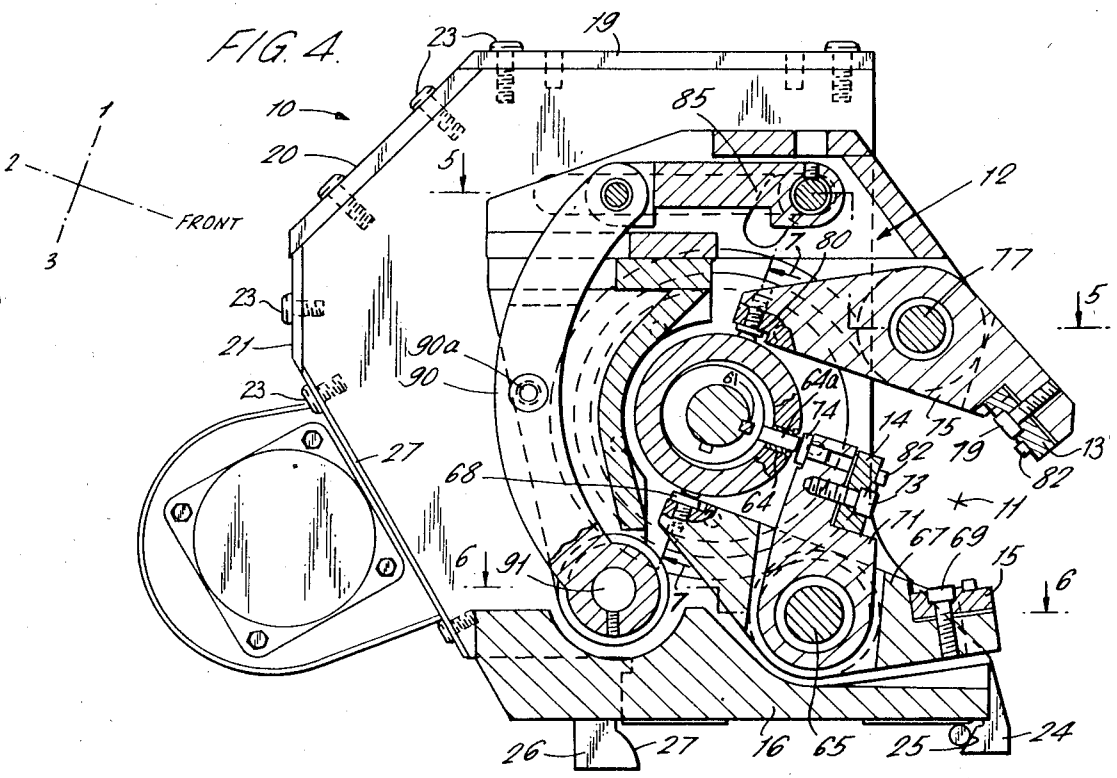
FIG. 4 is a section on the line 4—4 on FIG. 3.
Figure 5:
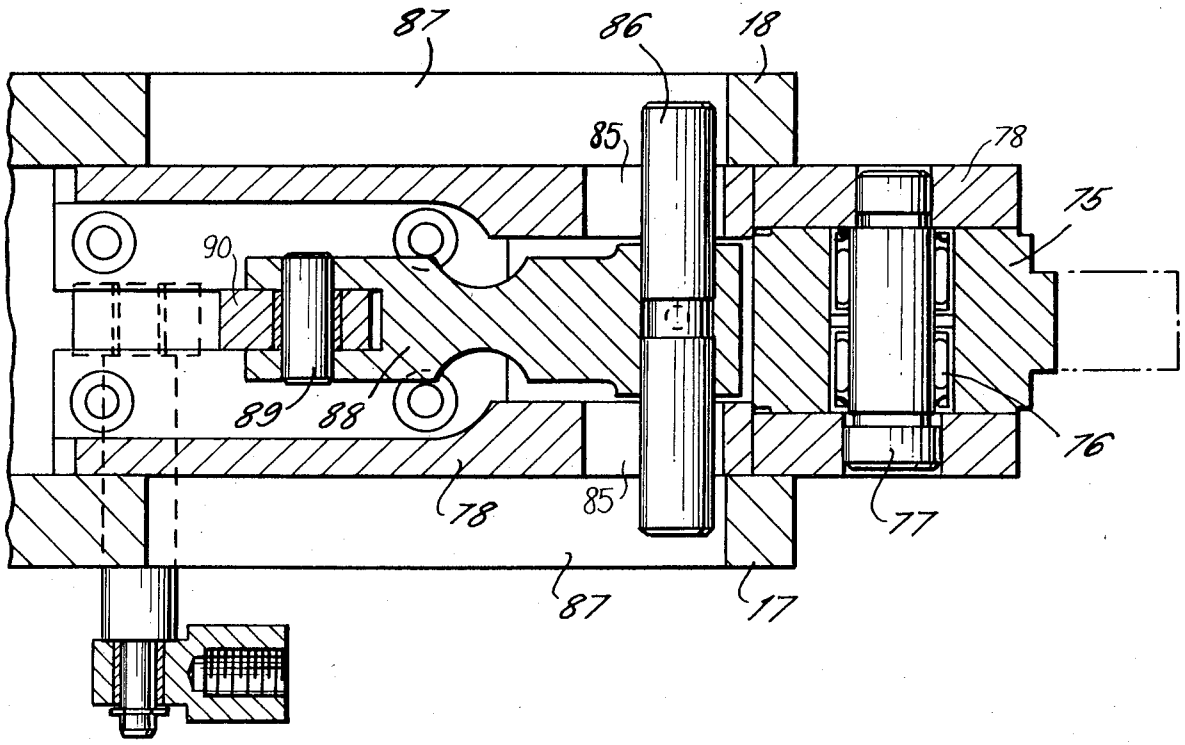
FIG. 5 is a section on the line 5—5 on FIG. 4.
Figure 6:
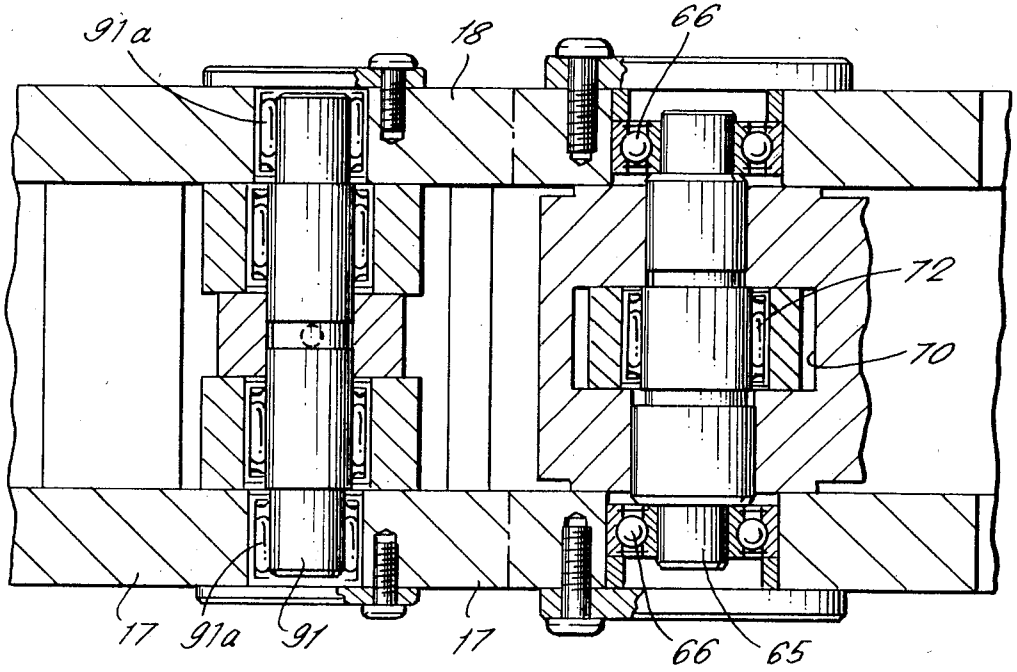
FIG. 6 is a section on the line 6—6 on FIG. 4.

The enlarged portion 47 of the shaft 44 carries three annular eccentric cams 58, 59 and 60 locked to rotate with the shaft 44 by keys 61. The hub 37 encircling the eccentric cams 58 to 60 has three radial bushes 64 disposed at spaced locations around the hub and in line with the three respective cams and three push rods **64*a* are mounted in the respective bushes to bear against the three respective cam surfaces 58 to 60. Referring to FIGS. 4 and 6 of the drawings, the shaft 65 extends between and is mounted in bearings 66 secured in the side walls 17, 18 of the housing. The shaft 65 supports a rocker arm 67 one end of which carries a pressure pad 68 which bears on the pushrod 64*a* acting on eccentric cam 58. The other end of the lever arm projects from the forward end of the housing and carries the guide element 15 secured to the arm by a set screw 69. The central part of the lever arm 67 around the shaft 65 is cut away as indicated at 70 in FIG. 6 to provide a recess in which a further rocker arm 71 is pivotally mounted on the shaft 65 on a needle roller bearing 72. The rocker arm 71 extends upwardly from the arm 67 towards the front end of the housing and the guide element 14 is secured to one side of the arm by a set screw 73 to project from the forward side of the housing. The other side of the arm has a pressure pad 74 recessed into the arm against which the push rod 64*a* acting on the eccentric cam 59 bears. In the upper part of the housing a further lever arm 75 is pivotally mounted by means of needle roller bearings 76 on a spindle 77 supported at its ends in a double walled arm 78. One end of the arm 75 carries the guide element 13 secured thereto by set screws 79 and the other end of the arm has a pressure pad 80 recessed into the end of the arm which bears against a final pushrod 64*a* acting on the eccentric cam 60**.

Each of the guide elements 13, 14 and 15 is provided with a small rectangular section steady tip 82 to engage the workpiece to be supported by the guide, and by rotation of the shaft 44 and with it the eccentric cams 58 to 60, the guide elements are moved into engagement with the workpiece to support the workpiece for rotation about the axis 11 as will be described below. The radial position of the hub 37 in which the shaft 44 is supported is adjusted by slackening the clamping collars 39 securing the hub to the annular plates 34, 35. Plate 54 carrying motor 55 and drive pulley 56 is secured to hub 37 and will therefore move with it. Adjustment of the shaft 44 enables the central axis of the guide elements 13, 14 and 15, toward which the guide elements close, to be adjusted for alignment with the axis 11 of rotation of the machine tool.

The double arm 78 supporting the lever 75 is supported in the housing for movement between the operative position indicated in FIG. 4 to a retracted position in which the lever arm 75 is retracted into the housing (as shown in FIG. 1) to permit the workpiece to be located in or removed from the guide by a mechanism which will now be described. The double arm 78 is formed with a short L-section slot 85 in both parts of the arm in which a pin 86 is located. The ends of the pin locate in horizontal slots 87 formed in the side walls 17, 18 of the housing. The pin is thus constrained to slide horizontally in the slots in the housing. A pivotal link 88 is connected at one end to the pin 86 between the two parts of the arm 78 and the other end of the link is connected by a further pin 89 to an arcuate link 90 as shown in FIG. 4 which extends downwardly through the housing behind the hub assembly 37. The lower end of the arm 90 is supported on a shaft 91 mounted in bearings **91*a* in the side walls 17 and 18 of the housing as shown in FIG. 6. A pin 90*a* is mounted on the arcuate arm 90 approximately halfway down the arm and projects laterally of the arm through arcuate slot 92 in the side wall 17 of the housing. A pneumatic ram 93 is mounted on the side wall 17 of the housing towards the upper end thereof and acting in a downwardly inclined direction and the piston rod 94 of the ram is connected to the pin 90*a* on the arm 90. When the ram 93 is extended, the arcuate arm 90 is pressed towards the rear of the housing and, in so doing, retracts the lower arm 75 into the housing to allow a workpiece to be moved into or out of the position by engagement by the guide element. When the ram 93 is retracted, the arm 90 is drawn forwardly to extend the lever arm 75 into the operative position around the axis 11 to support a workpiece coaxial with the axis. When the ram 93 is initially extended to retract the arm 75 the pin 86 travels along the short horizontal part of the dog-leg slot 85 in the arm 78 without causing any movement of the arm 75. When the pin comes to the downwardly inclined section of the dog-leg slot the arm 78 starts to move with the pin and the arm is raised and retracted into the housing as the pin runs down the slot until it reaches the bottom of the slot when the ram is fully extended and the rocker arm 75 is raised and almost fully retracted into the housing as shown in FIG. 1**.

Since the rocker arm 75 cannot retract until the pin 86 has reached the downwardly inclined section 85 of the dog-leg slot, the lever arm cannot be forced backwardly into the housing from its extended position by force alone on the lever arm itself. Thus, whatever load is applied to the lever arm, the arm will remain in its extended position until retracted by the pneumatic ram 93.

The workpiece guide is set up with a master component in the machine tool the axis of which coincides with the required degree of accuracy with the machine axis 11. The workpiece steady tips are then closed on to the master component with the fixing screws securing the hub 37 to the annular plates 34,35 sufficiently slack to allow the hub to adjust automatically to the position required to hold the workpiece guides gripping the master component. The hub is then locked in position and the guide is then ready for use.

As indicated earlier, the shaft 44 is driven by a stepper motor to contract and expand the workpiece guides 13, 14 and 15 around the workpiece to be supported in the guide. This enables the guide to be operated through an automatic cycle of the following steps initiated by operation of a cycle start button.

1. A solenoid valve operates to extend the ram 93 to advance arm 75 to the extended position.

1.1 By a switch or timer (allowing arm 75 to reach its extended position, the stepper motor is energised to advance 400 steps (equivalent to two full revolutions).

1.2 The steady tips 82 should contact the component and align it with the axis 11 and stall the stepper motor before 400 steps have been completed.

1.3 From its stall condition, the motor is reversed 10 steps to retract the steady tips slightly from the workpiece and allow a running clearance for the workpiece.

N.B. If the motor completes 400 steps then there is a "steady fault" which should be signalled and the machine cycle should be stopped at that point.

1.4 At completion of reversal, the motor is held stationary at maximum torque and should signal the start of rotation of the workhead of the workpiece and the start of the machining operation on the workpiece, e.g. a grinding cycle.

1.5 At the completion of the machining operation, the stepper motor is re-started in the reverse direction and run for −60 steps to retract the steady tips from the workpiece and the solenoid valve for the ram 93 is operated to retract the ram and thereby retract the upper rocker arm 75.

I claim:

1. A workpiece guide for supporting a rotary workpiece comprising a base, three jaw members movably mounted on the base to embrace and support a workpiece for rotation about a central axis defined by the positions of the jaw members, drive means drivably connected to the three jaw members for moving the jaw members toward the central axis thereof for closing the jaw members to grip the workpiece and for moving the jaw members away from the central axis to automatically release the jaw members by a predetermined amount to permit the workpiece to rotate therein while still supported coaxially with the axis by the jaw members irrespective of the workpiece diameter, and means for shifting as a unit the drive means and the jaw members drivably connected thereto relative to the base and transversely relative to the central axis, to adjust the central axis to coincide with an axis of a machine tool on which the guide is to be used whereby a workpiece supported by the guide has the axis thereof coincident with the machine tool axis whatever the workpiece diameter.

2. A workpiece guide as claimed in claim 1 wherein the jaw members are pivotally mounted about parallel axes on the base.

3. A workpiece guide as claimed in claim 2 wherein two of the jaw members are mounted to rotate on a common axis and the third jaw member is mounted to rotate about a further axis.

4. A workpiece guide as claimed in claim 3 wherein a carrier is movably mounted on the base, the third jaw member being mounted on the carrier, and means provided for locking the carrier in an operative position in which the third jaw member can embrace and support a workpiece with the other two jaw members and an inoperative position in which the third jaw member is disposed away from the first two jaw members to permit a workpiece to be removed laterally from between the jaw members or inserted between the jaw members.

5. A workpiece guide a claimed in claim 4 wherein the carrier comprises an arm pivotally mounted in the base, the third jaw member being mounted on the arm for movement together therewith about a pivotal axis, and means provided for swinging the arm about the pivotal axis to move the third jaw member between the operative and inoperative positions.

6. A workpiece guide as claimed in claim 5 wherein the means for moving the arm comprises a double acting ram.

7. A workpiece guide as claimed in claim 5 wherein the base comprises a housing having a pair of spaced walls rigidly connected together, two of the jaw members being pivotally mounted a on shaft extending between and rotatably mounted in the housing walls, a further shaft lying parallel to the shaft which extends between the walls, the arm being pivotally mounted on the further shaft, and the adjusting means including means for adjustably mounting the drive means on the walls to adjust the positions of the jaw members relative to the walls and to thereby adjust the closing axis to coincide with the machine tool axis.

8. A workpiece guide as claimed in claim 1 wherein the base is provided with a clamp for fixing the base to a worktable of a machine tool.

9. A workpiece guide as claimed in claim 1 wherein the drive means for closing and releasing the jaw members comprise a rotary cam means mounted on the base and cam follower means in engagement with the jaw members and the cam means to close and release the jaw members with rotation of the cam means.

10. A workpiece guide as claimed in claim 9 wherein the drive means further comprises a hub mounted on the base and having three radial bores at spaced locations along its length, said cam follower means comprising three push rods respectively contained in said bores for acting on the three jaw members respectively, the rotary cam means further comprising a cam shaft mounted in the hub and having three annular cam surfaces engaging the three push rods respectively to displace the push rods and thereby the jaw members in accordance with a rotational position of the shaft and thereby to close and release the jaw members.

11. A workpice guide as claimed in claim 10 wherein a reversible stepper motor is drivably connected to said cam shaft.

12. A workpiece guide as claimed in claim 10 wherein the hub is adjustably mounted on said base in directions perpendicular to a central axis of the hub such that adjustment of the hub correspondingly adusts the jaw members and thereby said closing axis of the jaw members.

13. A workpiece guide as claimed in claim 12 wherein the base comprises a housing having a pair of spaced walls rigidly connected together and provided with opposing apertures to receive opposite ends of the hub respectively, and means being provided for adjustably mounting the ends of the hub in the apertures of the walls.

14. A workpiece guide as claimed in claim 13 wherein the hub has one end provided with an integral annular ring and a separate ring with means for clamping the two rings to one of the walls in which the end of the hub is located, and the other end of the hub has two encircling separate annular rings, and clamping means being provided to clamp the rings to the other wall in which the other end of the hub is located.

15. A workpiece guide as claimed in claim 14 wherein the means to clamp the annular rings on the hub to the walls comprise bolts extending between the ring.

16. A workpiece guide for supporting a rotary workpiece comprising a base, three jaw members movably mounted on the base to embrace and support a workpiece for rotation about a central axis defined by the positions of the jaw members, drive means comprising a rotary cam means mounted on the base and cam follower means in engagement with the jaw members and with the rotary cam means for moving the jaw members toward the central axis for closing the jaw members to grip the workpiece and for moving the jaw members away from the central axis for releasing the jaw members sufficiently with rotation of the rotary cam means to permit the workpiece to rotate therein while still supported coaxially with said central axis by the jaw members irrespective of the workpiece diameter, the rotary cam means having a central cam axis; means for movably mounting the rotary cam means on the base for adjustment in directions perpendicular to the central cam axis to adjust the relative positions of the jaw members on which the cam means is acting to adjust the central axis of the jaw members to coincide with an axis of a machine tool on which the guide is to be used whereby a workpiece supported by the guide has its axis coincident with the machine tool axis whatever the workpiece diameter.

17. A workpiece guide as claimed in claim 16 wherein the base comprises a housing having a pair of spaced walls rigidly connected together, two of the jaw members being pivotally mounted on a shaft extending between the walls, and a third jaw member being pivotally mounted on a shaft mounted on the housing and parallel to the shaft extending between the walls, and the cam means for operating the jaw members being adjustably mounted on said walls.

18. A workpiece guide as claimed in claim 17 wherein a hub is mounted on said walls and contains a shaft having three annular cam surfaces defining the cam means, the walls being formed with opposing bores in which the hub is mounted, inwardly projecting annular flanges provided on the walls around the bores, and annular clamping means provided on the hub for clamping the hub in a predetermined position relative to the flanges upon the adjustment perpendicular to the cam axis.

19. A workpiece guide as claimed in claim 18 wherein the hub has at one end an integral annular ring and a separate ring with means for clamping the rings to the annular flange on one of the housing walls and has at the other end thereof two further separate annular rings having means to clamp the rings to the annular flange on the other housing wall.

20. A workpiece guide as claimed in claim 18 wherein the means to clamp the annular rings on the hub to the respective annular flanges comprise bolts extending between the rings and through apertures in the flanges to permit the hub to be adjusted with respect to the flanges when the bolts are slackened.

21. A workpiece guide for supporting a rotary workpiece comprising a base, three jaw members movably mounted on the base to embrace and support a workpiece for rotation about a central axis defined by the positions of the jaw members, drive means comprising a rotary cam means mounted on the base and cam follower means in engagement with the jaw members and in the rotary cam means for moving the jaw members toward the central axis for closing the jaw members to grip the workpiece and for moving the jaw members away from the central axis for releasing the jaw members sufficiently with rotation of the rotary cam means to permit the workpiece to rotate therein while still supported coaxially with said central axis by the jaw members irrespective of the workpiece diameter, said drive means further comprising a hub mounted on the base and having three radial bores at spaced locations along its length, said cam follower means comprising three push rods located in said bores and respectively acting on the three jaw members, said rotary cam means comprising a cam shaft mounted in the hub and having three annular cam surfaces engaging the three push rods respectively to displace the push rods and thereby the jaw members in accordance with a rotational position of the shaft and thereby to close and release the jaw members.

22. A workpiece guide for supporting a rotary workpiece comprising a base, three jaw members each mounted on the base for independent movement to embrace and support a workpiece for rotation about a central axis defined by the positions of the jaw members, drive means drivably connected to the three jaw members for moving the jaw members toward the central axis for closing the jaw members to grip the workpiece and for moving the jaw members away from the central axis for automatically releasing the jaw members by a predetermined amount to permit the workpiece to rotate while still supported coaxially with the axis by the jaw members irrespective of the workpiece diameter, and means for shifting as a unit the drive means and the jaw members drivably connected thereto relative to the base and in a plane perpendicular to the central axis to adjust the central axis to coincide with an axis of a machine tool on which the guide is to be used whereby a workpiece supported by the guide has its axis concident with the machine tool axis whatever the workpiece diameter.

* * * * *